US008073578B1

(12) United States Patent
McCusker

(10) Patent No.: US 8,073,578 B1
(45) Date of Patent: Dec. 6, 2011

(54) METHOD AND SYSTEM FOR THE CURSOR-AIDED MANIPULATION OF FLIGHT PLANS IN TWO AND THREE DIMENSIONAL DISPLAYS

(75) Inventor: Patrick D. McCusker, Walker, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 640 days.

(21) Appl. No.: 12/284,319

(22) Filed: Sep. 18, 2008

(51) Int. Cl.
*G06G 7/72* (2006.01)

(52) U.S. Cl. ..... 701/3; 701/8; 701/9; 701/10; 701/14; 701/301

(58) Field of Classification Search ..... 701/3, 8–10, 701/14, 208, 300, 301; 340/903, 963, 970, 340/438

See application file for complete search history.

(56) References Cited

U.S. PATENT DOCUMENTS 6,377,892 B1 4/2002 Johnson
6,571,155 B2 5/2003 Carriker
6,785,594 B1 8/2004 Bateman
6,816,780 B2 11/2004 Naimer
6,970,784 B2 11/2005 Shinagawa
6,980,892 B1 12/2005 Chen
6,995,690 B1 * 2/2006 Chen et al. ..... 340/974
7,302,318 B2 11/2007 Gerrity
7,554,483 B2 * 6/2009 Markiton et al. ..... 342/33

* cited by examiner

*Primary Examiner* — Richard M. Camby
(74) *Attorney, Agent, or Firm* — Daniel M. Barbieri

(57) ABSTRACT

A method of creating and modifying a flight plan using a cursor control device and a display to represent the flight plan in the context of terrain. The method includes inserting waypoints, including origin and destination waypoints, into a flight plan using a cursor control device to position the waypoints in a display and commanding a flight management system (FMS) to connect the waypoints into a flight plan. The flight plan is drawn in the context of terrain on a display where conflicts between the flight plan and terrain are indicated. Selected elements of the flight plan are selected with a cursor control device and the selected elements are dragged to new positions on the display until terrain conflicts are eliminated, thus generating a modified flight plan. The modified flight plan is reviewed in the context of terrain to determine its acceptability and making further modifications thereof if desired. The modified flight plan is selected from the review thereof, the modified flight having no conflicts with terrain. Finally, the modified flight plan is activated using the FMS.

16 Claims, 20 Drawing Sheets

METHOD AND SYSTEM FOR THE CURSOR-AIDED MANIPULATION OF FLIGHT PLANS IN TWO AND THREE DIMENSIONAL DISPLAYS

BACKGROUND OF THE INVENTION

1. Field of the Invention

The present invention relates generally to aircraft flight path design, and more particularly to cursor-aided manipulation of flight plans in flight displays.

2. Description of the Related Art

There are two basic sets of rules for flight operations, Visual Flight Rules (VFR) and Instrument Flight Rules (IFR). Visual Meteorological Conditions (VMC) are those weather conditions in which pilots have sufficient visibility to maintain visual separation from terrain, obstacles, and other aircraft. Instrument Meteorological Conditions (IMC) are those weather conditions in which pilots cannot maintain visual separation from terrain, obstacles, and other aircraft.

Under Visual Flight Rules (VFR), the pilot maintains separation from terrain, obstacles, and other aircraft by visual reference to the environment surrounding the aircraft. The guiding principle for VFR is "See and Avoid". Under Instrument Flight Rules (IFR), the pilot maintains separation from terrain and obstacles by reference to aircraft instruments only. The guiding principle for IFR is "Positive Course Guidance" to track a "hazard-free path" which provides separation from terrain and obstacles. Separation from other aircraft is provided by Air Traffic Control. VFR principles may only be used under VMC; however, IFR principles are used under both VMC and IMC.

A key aspect of operating in IMC is determining the accuracy of the aircraft navigation systems and the performance of the pilot or automated flight systems. All navigation systems have an uncertainty in their ability to determine the position of the aircraft. The magnitude of the uncertainty is driven by the underlying technologies that are used to implement the navigation system. All pilots and automated flight systems have limitations in their ability to track an intended flight path. These limitations result in deviations between the actual position of the aircraft versus the intended position of the aircraft. This deviation in aircraft position is known as flight technical error ("FTE"). The total system error ("TSE") is the combination of uncertainty in the navigation system and the flight technical error of the pilot or automated flight system. IFR operating procedures are designed to accommodate the TSE. The greater the possible TSE, the larger the buffer must be between the intended path of the aircraft and terrain, obstacles, or other potential hazards to the aircraft.

The simplest form of IFR operations is dead-reckoning where the pilot navigates using only magnetic heading, airspeed, and time. This allows the pilot to estimate his/her location by using a map to identify a starting point then using heading, speed, and time to determine distance and direction traveled from the starting point. Dead-reckoning is highly inaccurate in windy conditions because the pilot cannot accurately determine the actual ground speed or aircraft track (which differ from airspeed and heading due to the velocity of the wind). Modern inertial navigation systems automate the dead-reckoning process and provide much higher accuracies than the pilot can achieve without assistance. However, even the best, and most expensive, inertial navigation systems suffer from position errors that increase over time (typically with a drift rate of 2 nautical miles or more per hour). Thus, operating by dead-reckoning can result in a very large TSE.

Various navigational aides (NAVAIDS) have evolved over time to improve the accuracy of navigation in IMC, resulting in lower TSE. The first generation of NAVAIDS includes ground-based navigation radio systems such as VHF Omnidirectional Range (VOR), Distance Measuring Equipment (DME), and Instrument Landing System (ILS). These solutions allow an airborne radio receiver to determine either bearing to a ground-based transmitter (e.g. VOR) or distance to the transmitter (e.g. DME). The ILS is a specialized system that allows the airborne radio receiver to determine angular deviation from a specific bearing from the transmitter (Localizer) and specific descent path (Glide Slope). While these systems provide significant improvement in accuracy over inertial navigation systems, they require very expensive ground infrastructures which limit the number of locations where they may be installed.

Another disadvantage of ground-based radio positioning systems is that such systems provide less certainty of an aircraft's position the farther the aircraft is from the transmitter. Recognizing this limitation, regulators have established a set of criteria for building instrument-based navigational procedures called TERPS (Terminal Instrument Procedures) for designing approaches that recognize the limitations of the technology. TERPS employs trapezoidal obstacle identification surfaces that take into account inaccuracies in the aircraft's positional certainty. TERPS is formally defined in US FAA Order 8260.3B, along with associated documents in the 8260 series. The international equivalent of TERPS is called PANS-OPS, promulgated by the International Civil Aviation Organization ("ICAO") (document 8168); the two combined represent virtually 100% of conventional approaches in place today. Procedures developed in accordance with the TERPS or PANS-OPS have serious limitations in that they are written using "lowest common denominator" aircraft performance expectations. The smallest general aviation aircraft and the largest transport jets all use the same procedures to depart and arrive at terrain-challenged airport in IMC regardless of the capabilities of the aircraft or aircrew.

The next generation of NAVAIDS exploits the Global Positioning System (GPS) infrastructure which was deployed by the Department of Defense. Airborne Satellite Navigation (SATNAV) receivers can calculate the current position of the aircraft to far greater accuracy than can be achieved with VOR and DME, with a lower TSE than using VOR and DME, and can provide similar performance to ILS near the runway threshold with similar TSE.

An emerging model for IFR operations defines operating procedures based upon the concept of Required Navigation Performance (RNP). Instead of defining approach and departure paths based upon the lowest accuracy of the available NAVAIDS, RNP defines the minimum performance requirements that an airborne system must achieve to use a published RNP procedure. In addition, a new paradigm is emerging that allows RNP procedures to be developed and published that assume Special Aircraft and Aircrew Requirements (SAAAR). Even though RNP-SAAAR procedures are published (and therefore public), they may only be used by aircraft operators that have been authorized in advance by the regulatory authorities. These RNP-SAAAR procedures will allow complex approach and missed approach procedures at terrain-challenged airport in IMC; however, there are hundreds of terrain-challenged airports around the world, and it will be a long time before procedures are developed and published for all the airports. In fact, it may be too expensive to develop RNP-SAAAR procedures for small airports that have very low utilization.

Thus, as discussed above, the TERPS defines the criteria for the creation of arrival procedure from top of descent through a successful landing or a missed approach. The TERPS uses the maximum allowed TSE for each type of navigation solution to define the necessary Obstacle Clearance Surface (OCS) (i.e., buffer between the aircraft and hazards) for a corresponding type of approach or missed approach (e.g., a precision approach versus a non-precision approach).

The missed-approach point is the location along the approach path that the pilot must decide to continue the landing or to go around. Precision approaches have a Decision Height (DH) where the pilot must decide to land or go around. Non-precision approaches have a Minimum Descent Altitude (MDA) (i.e. lowest published descent altitude), where the pilot must have visual reference to the airport to proceed. Decision heights range from 0 feet above the runway (Cat IIIc) to 200 feet (Cat I) while minimum descent altitude range from hundreds of feet to thousands of feet above the runway.

FIG. 1 (Prior Art) is a schematic illustration of a typical approach of the path of an aircraft from top of descent to missed approach point and then through the missed approach procedure where the minimum descent altitude is driven by terrain and obstacles along the approach path and/or the missed approach path.

FIG. 2 (Prior Art) shows the situation where terrain along the non-precision approach path requires the MDA to be substantially higher than the typical Decision Height on a precision approach.

FIG. 3 (Prior Art), FIG. 4 (Prior Art) and FIG. 5 (Prior Art) show the TERPS-required OCS relative to the approach path shown in FIG. 2. FIG. 3 shows the elevation difference between the intended path and the OCS where the elevation difference is derived from the vertical component of the maximum TSE of the navigation solution used to perform the approach. FIG. 4 shows a cross-sectional view of the OCS where the width of the OCS is derived from the horizontal component of the maximum TSE of the navigation solution used to perform the approach. The MDA is determined from the point where the terrain penetrates the OCS. In order to descend below the MDA, the pilot must have some means to avoid the terrain that is penetrating the OCS. This can be accomplished by the pilot having sufficient visibility to "see and avoid" the terrain or by using a better navigation solution that results in a lower TSE thereby reducing the distance to the OCS. Alternately, a different approach path may be used to avoid the terrain conflict entirely. This invention provides a system and method for generating an alternative path to avoid the terrain conflict. FIG. 5 shows a top-down view of the approach path and the location where terrain penetrates the OCS. FIG. 6 shows an example of a flight path that bends laterally around the terrain cell which caused the conflict with the original flight path shown in FIGS. 3, 4, and 5.

It is highly desirable to find a means to allow an aircraft to descend below published MDAs to increase the probability that the flight can proceed to a successful landing instead of the flight diverting to an alternative airport.

U.S. Pat. No. 7,302,318, entitled "Method for Implementing Required Navigational Performance Procedures" issued to D. J. Gerrity et al, discloses a method for designing an approach for a selected runway. The method includes gathering data regarding the height and location of all obstacles, natural and man-made, within an obstacle evaluation area. A preliminary approach path is laid out for the runway, including a missed approach segment, and a corresponding obstacle clearance surface is calculated. In the preferred method the OCS includes a portion underlying the desired fixed approach segment, and may be calculated using a vertical error budget approach. The OCS includes a missed approach segment that the aircraft will follow in the event the runway is not visually acquired by the time the aircraft reaches a decision altitude. A momentary descent segment extends between the first segment and the missed approach, and is calculated on physical principles to approximate the projected path of the aircraft during the transition from its location at the decision altitude to the missed approach segment. The preliminary path is then tested to insure that no obstacles penetrate the missed approach surface, and may be improved, e.g. lowering the decision altitude, by adjusting the OCS until it just touches an obstacle.

SUMMARY OF THE INVENTION

In a broad aspect, the present invention is a method of creating and modifying a flight plan to avoid terrain conflicts using a cursor control device and a display to represent the flight plan in the context of terrain. The method includes inserting waypoints, including origin and destination waypoints, into a flight plan using a cursor control device to position the waypoints in a display and commanding a flight management system (FMS) to connect the waypoints into a flight plan. The flight plan is drawn in the context of terrain on a display where conflicts between the flight plan and terrain are indicated. Selected elements of the flight plan are selected with a cursor control device and the selected elements are dragged to new positions on the display until terrain conflicts are eliminated, thus generating a modified flight plan. The modified flight plan is reviewed in the context of terrain to determine its acceptability and further modifications made if desired. The modified flight plan is selected from the review thereof, the modified flight having no conflicts with terrain. Finally, the modified flight plan is activated using the FMS.

The terrain conflicts are generally calculated from comparing the intended path of the aircraft, as defined by the flight plan, with the obstacle clearance requirements of Terminal Instrument Procedures (TERPS). As used hereinafter the term "TERPS" is meant to broadly refer to both the U.S. terminal instrument procedures and the international equivalent.

DETAILED DESCRIPTION OF THE INVENTION

Figure 1:
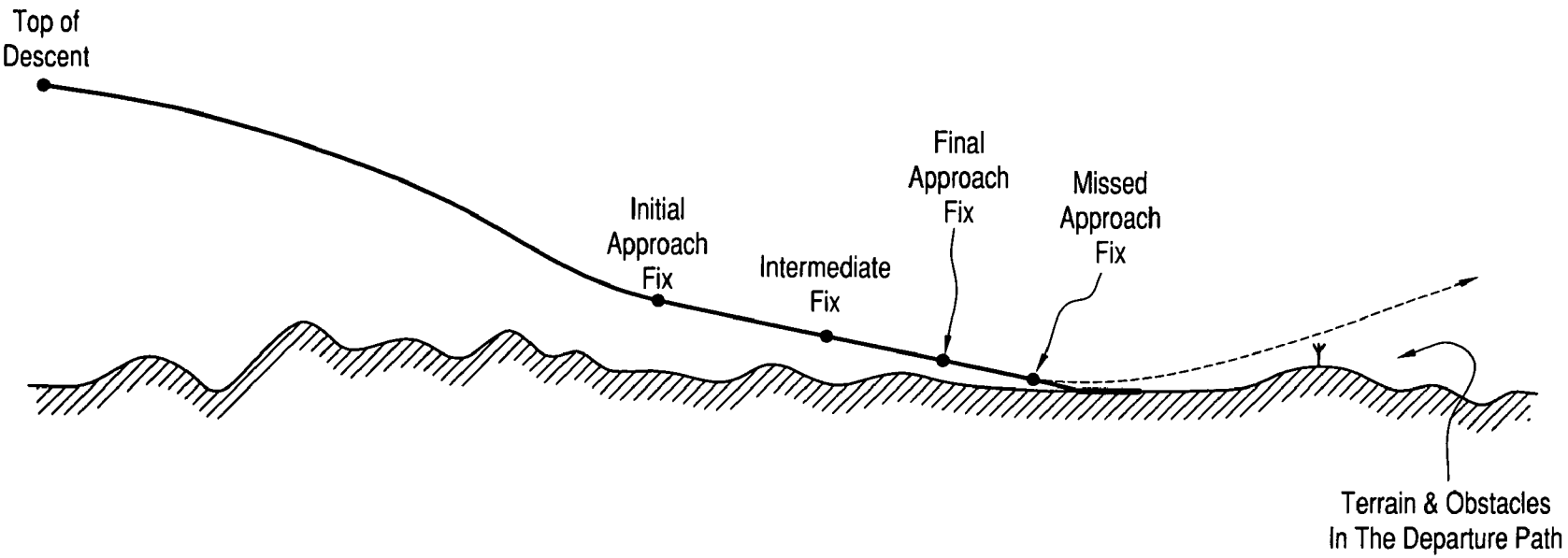
FIG. 1 (PRIOR ART)
FIG. 1 (Prior Art) is a schematic illustration of a typical approach of the path of an aircraft from top of descent to missed approach point and then through the missed approach procedure where the minimum descent altitude is driven by terrain and obstacles along the approach path and/or the missed approach path.
Figure 2:
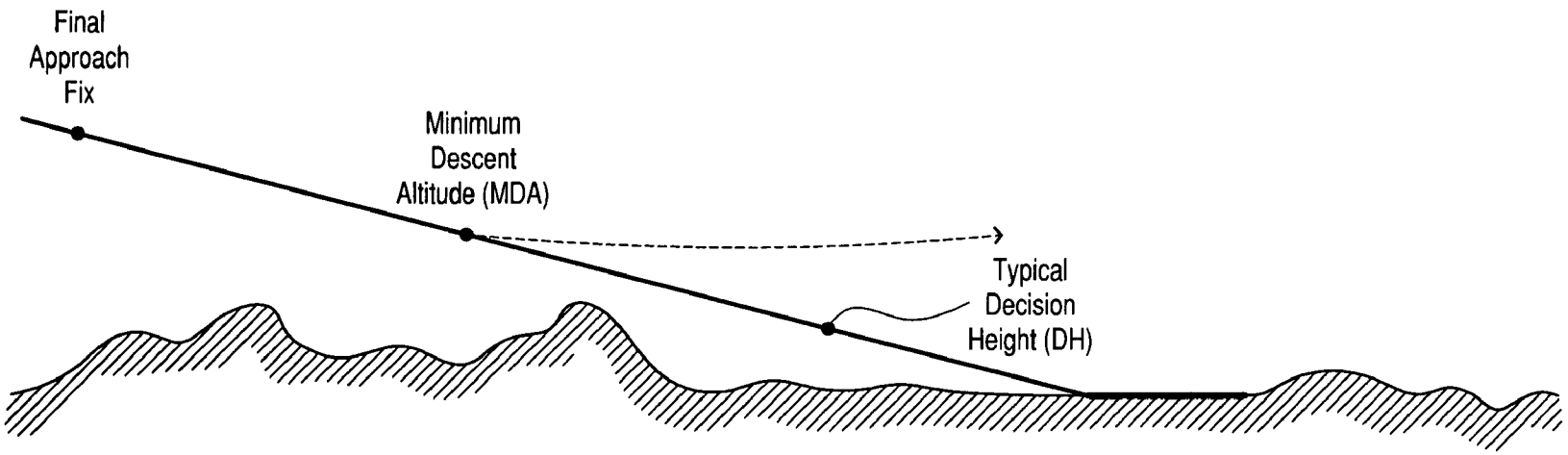
FIG. 2 (PRIOR ART)
FIG. 2 (Prior Art) is a schematic illustration of a situation where terrain along the non-precision approach path requires the Minimum Descent Altitude (MDA) to be substantially higher than the typical Decision Height (DH) on a precision approach.
Figure 3:
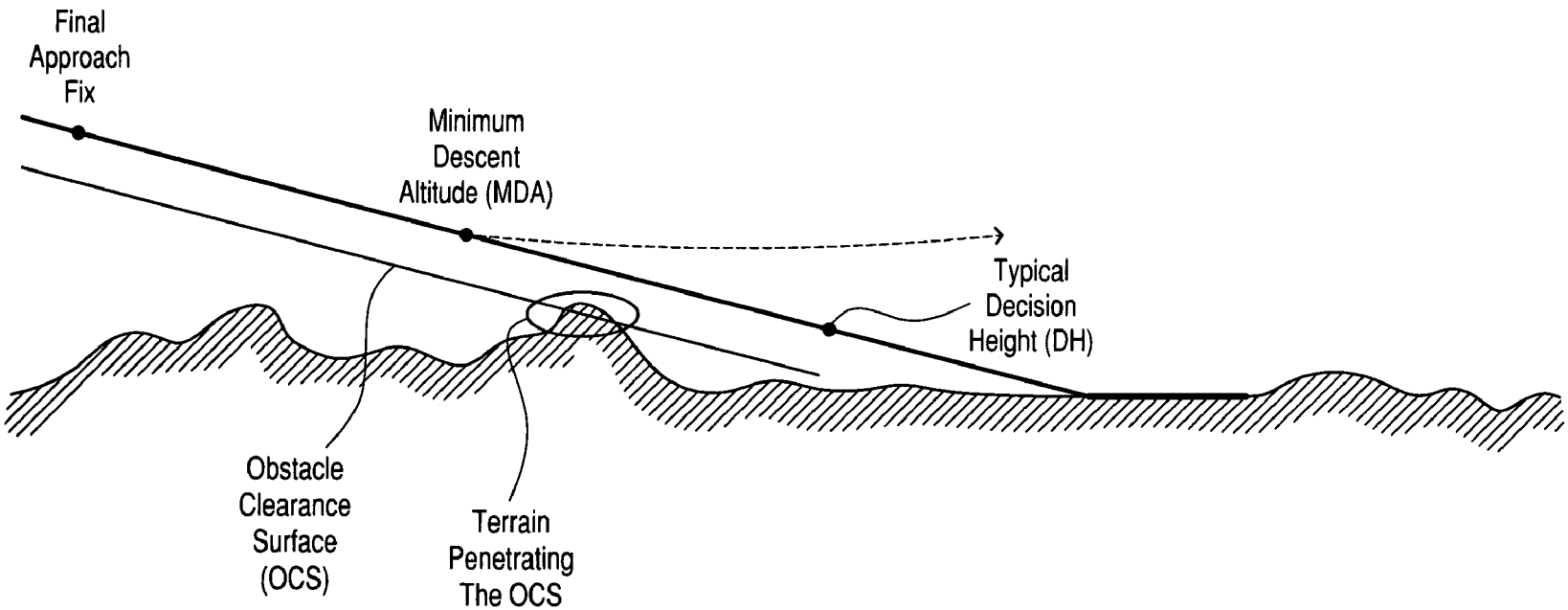
FIG. 3 (PRIOR ART)
FIG. 3 (Prior Art) is a schematic illustration of a situation where terrain penetrates the Obstacle Clearance Surface (OCS) along the approach path show in FIG. 2, where the elevation difference between the intended path and the OCS is derived from the TERPS using the required navigation performance ("RNP") for the approach procedure. The RNP is related to the maximum allowed TSE for the approach procedure.
Figure 4:
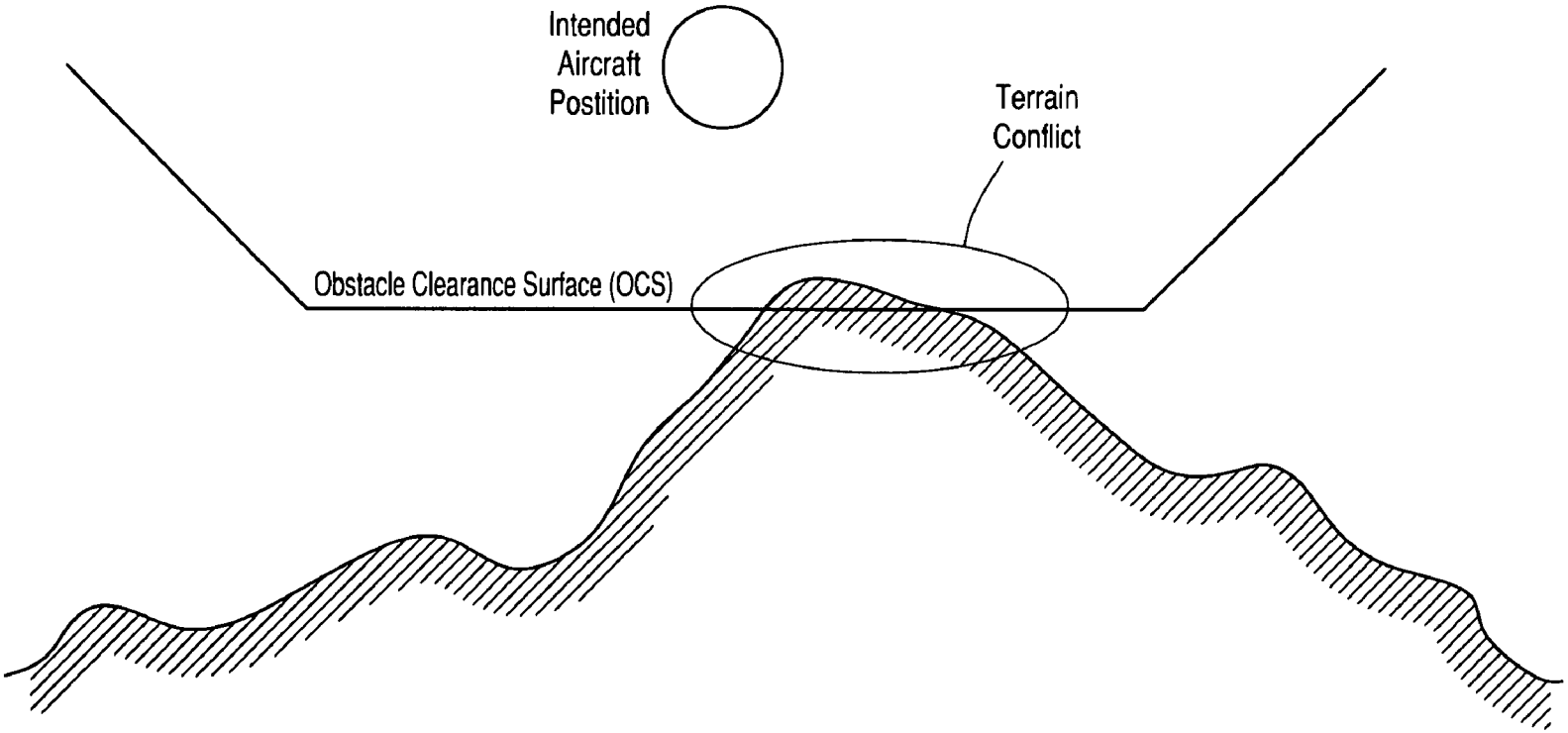
FIG. 4 (PRIOR ART)
FIG. 4 (Prior Art) is a cross-sectional view of a situation where terrain penetrates the OCS as shown in FIG. 3, where the width of the OCS is defined by the TERPS using the RNP for the approach procedure.

Referring to FIG. 4 (Prior Art), a cross-sectional view of the intended flight path within the obstacle clearance surface (OCS), due to the large total system error that is possible under IFR is shown. The aircraft could be anywhere within the boundaries of the OCS.

Figure 5:
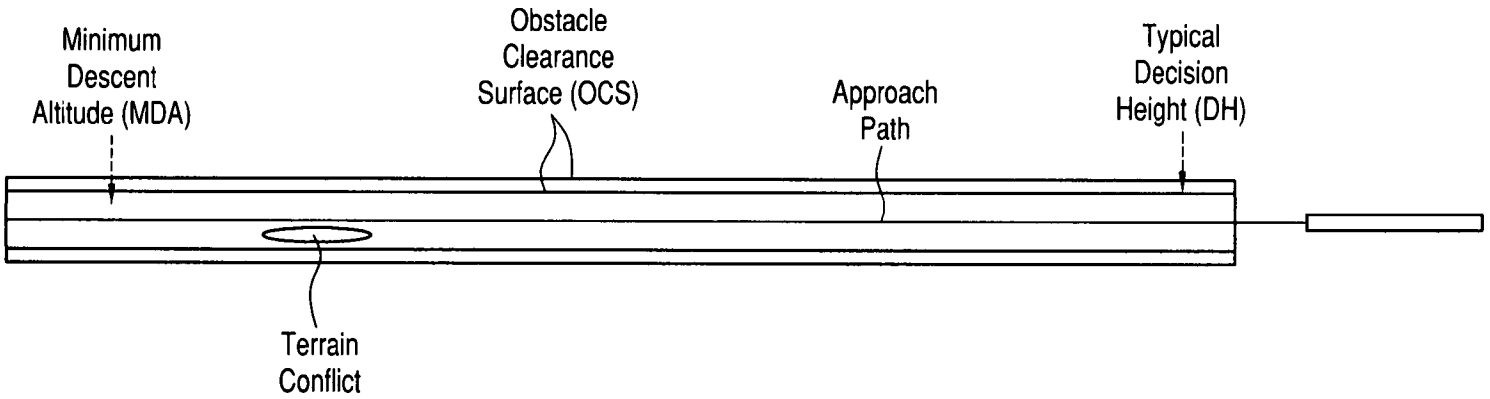
FIG. 5 (PRIOR ART)
FIG. 5 (Prior Art) is a top-down view of a situation where terrain penetrates the OCS as shown in FIGS. 3 and 4 for a straight-in approach to a runway.

As shown in FIG. 5 (Prior Art), a top down view of the intended flight path within the OCS, TERPS assumes that the aircraft will follow a straight-in path to the aircraft on most final approaches. Because the top of the terrain projects into the OCS, the pilot must fly the final approach with sufficient visibility to see the runway environment prior to reaching the terrain cell of interest—therefore MDA is before the terrain cell (well before a more typical decision height for a precision landing).

Figure 6:
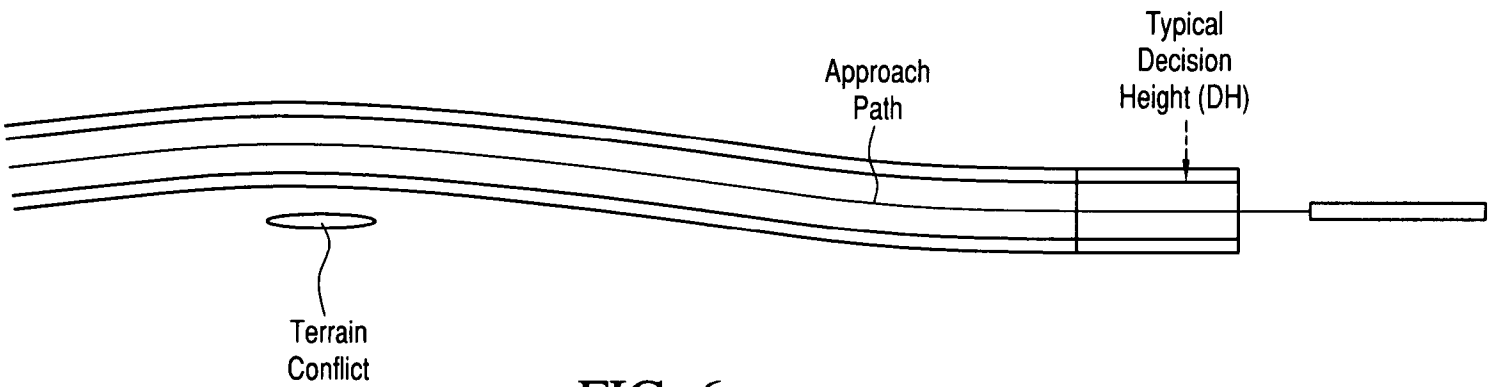
FIG. 6 illustrates the bending of the intended flight path around the terrain cell of interest in accordance with the principles of the present invention.

Referring to FIG. 6, the goal of the present invention is to bend the intended flight path around the terrain cell of interest; however, this is very challenging. The present invention allows the pilot to generate a curved-approach around threatening terrain on a just-in-time basis (e.g., prior to reaching the final approach fix). This curved approach may be represented by a Highway in the Sky to support manual flight operations or may be programmed into an FMS to allow for automated flight operations.

Figure 7:
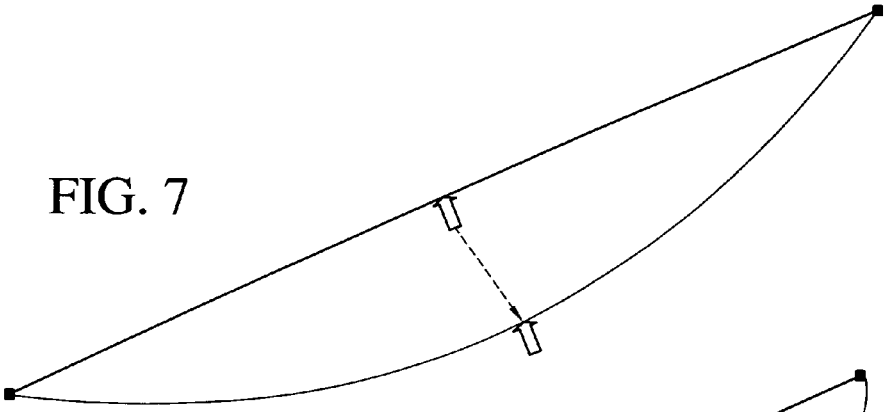
FIG. 7 illustrates the bending a flight segment by pulling center of the center of the flight segment in a nearly perpendicular fashion.
Figure 8:
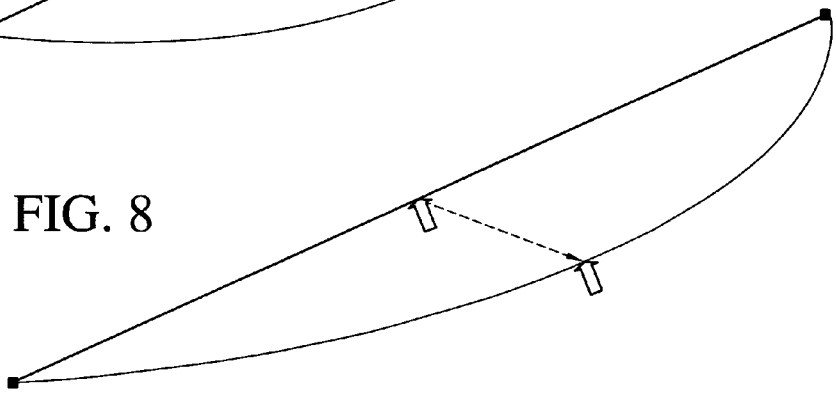
FIG. 8 illustrates stretching the flight segment into an asymmetrical curve by pulling away from the original line in an oblique angle.

Referring now to FIG. 7, a simple function is shown to bend a line segment. The user grabs the line in the middle and pulls the line into a smooth arc. If the user pulls in a nearly perpendicular fashion, the resulting arc is symmetric about the middle of the line segment FIG. 8 shows the user stretching the arc into an asymmetrical curve by pulling away from the original line in an oblique angle.

Figure 9:
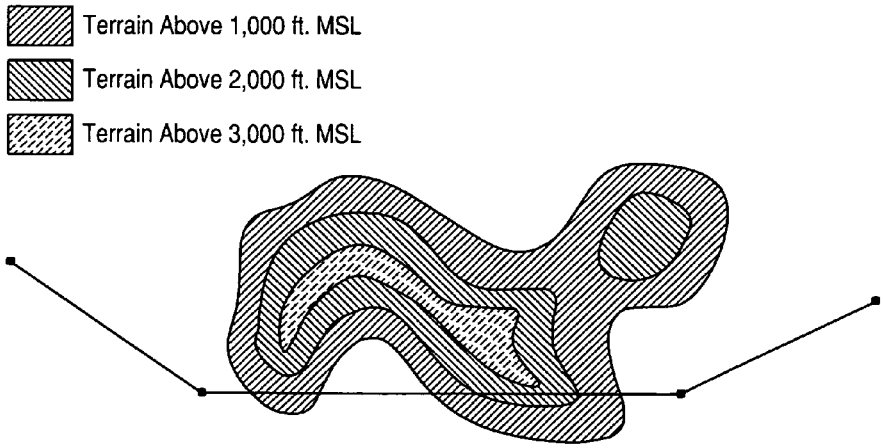
FIG. 9 illustrates a top-down, two-dimensional flight plan map with the flight plan conflicting with the terrain.

Referring now to FIG. 9, a top-down, two-dimensional flight plan map is illustrated, with the flight plan conflicting with the terrain. A flight plan has been created to traverse around a terrain feature. In this example, terrain less than 1,000 ft MSL is not shown. The flight plan has an intended aircraft altitude at 2,000 ft MSL. So, the flight plan in its current form conflicts with the terrain.

The normal process for modifying this flight plan requires the flight crew to enter waypoints in a Latitude/Longitude format to define the new path of the aircraft. To fix this flight plan using the existing art, the pilot would be required to calculate multiple waypoints in his/her head, enter them as text through a multi-function control display unit, then build the new path segment-by-segment.

Figure 10:
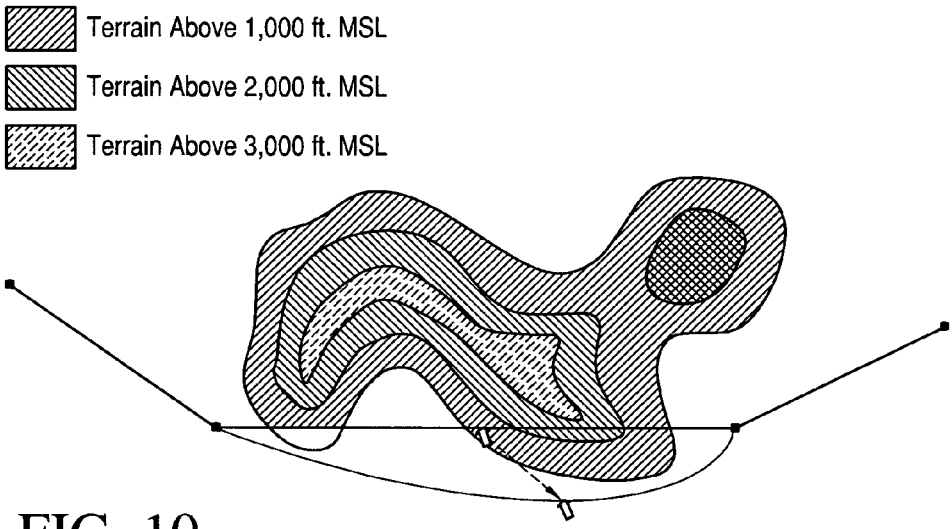
FIG. 10 illustrates a first step in defining a new flight path that does not conflict with the terrain.

The present invention involves a multi-step method to define a new flight path that does not conflict with terrain. Referring now to FIG. 10, in a first step, the user grabs the middle of the flight segment that is in conflict with terrain and then stretches it until there are no terrain conflicts. Note that this new path has a sharp angle where the bent segment intersects with the original flight plan.

Figure 11:
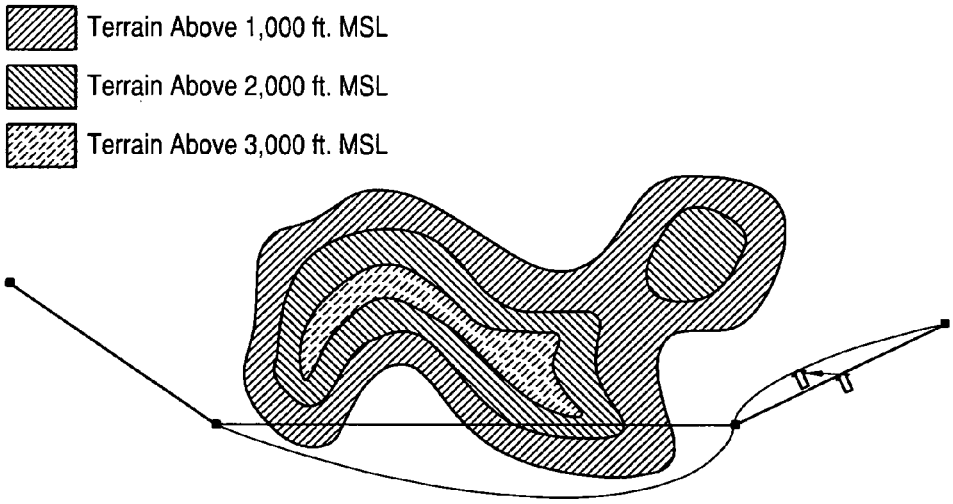
FIG. 11 illustrates a second step in defining the new flight path by grabbing the next segment in the flight plan and stretching it to achieve a smoother intersect between the two adjacent segments.

In a second step, shown in FIG. 11, the user grabs the middle of the next segment in the flight plan and stretches it to achieve a smoother intersect between the two adjacent segments.

Figure 12:
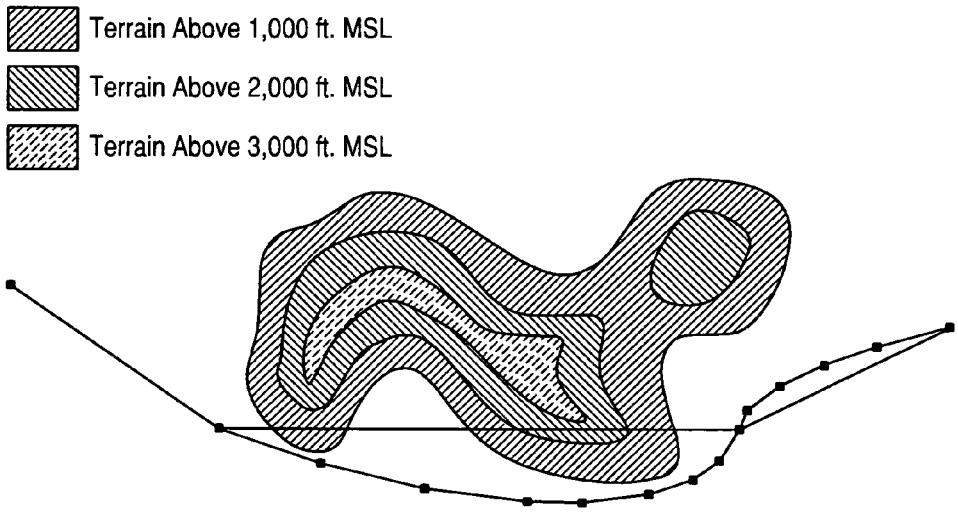
FIG. 12 illustrates a third step in defining the new flight path by generation of the FMS of the new flight plan using a series of short, straight segments.

In a third step, shown in FIG. 12, the user converts the curved path into a new flight plan. The FMS generates the new flight plan using a series of short, straight segments. These segments are built using Track-to-Fix (TF) waypoints which are the simplest mechanism for the FMS to generate a new flight plan. Alternatively, the FMS may use a combination of Track-to-Fix (TF) and Radius-to-Fix Waypoints. The RF waypoint allows the FMS to define a curved path with fewer waypoints than using many TF waypoints to approximate the curved path. In this case, the new flight plan would be constructed from a combination of straight and curved segments.

Figure 13:
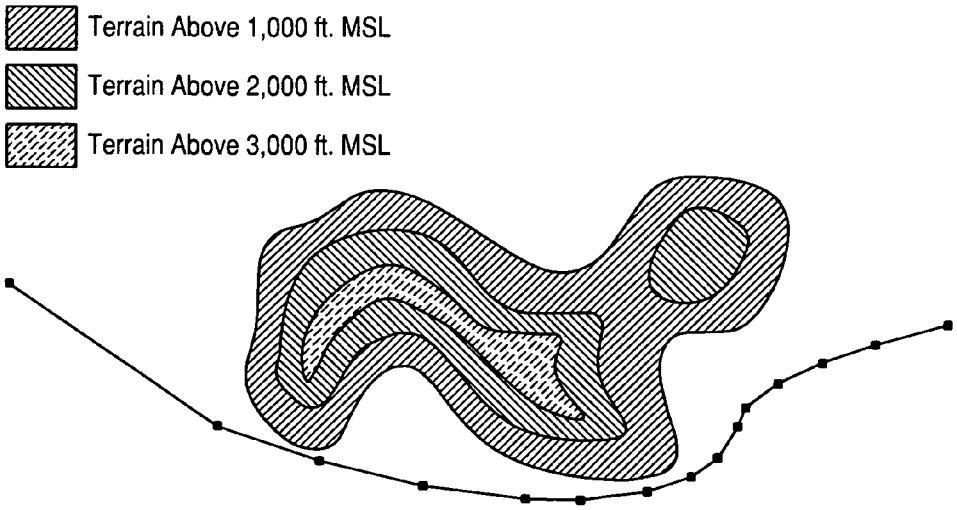
FIG. 13 illustrates a fourth step by deletion of the old flight plan.
Figure 14:
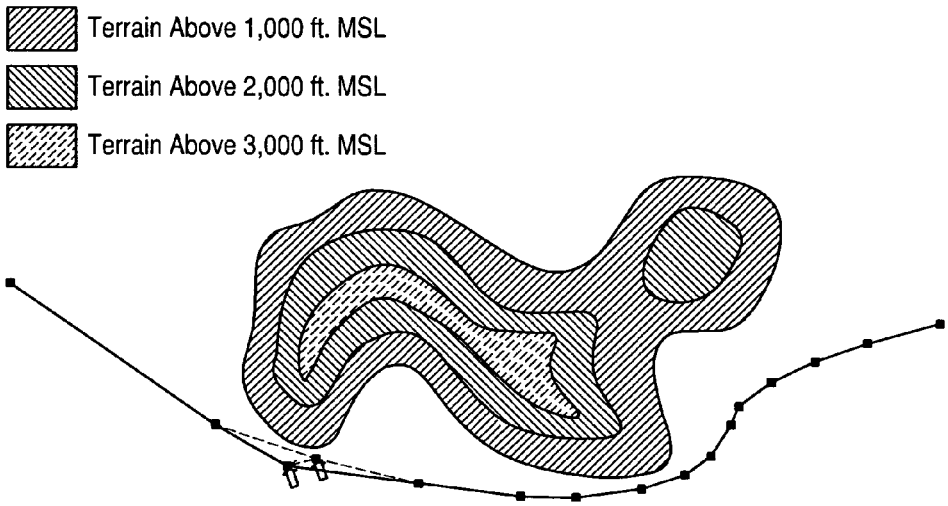
FIG. 14 illustrates a potential modification of the flight plan by pulling an individual waypoint to provide more clearance between the flight plan and terrain.
Figure 15:
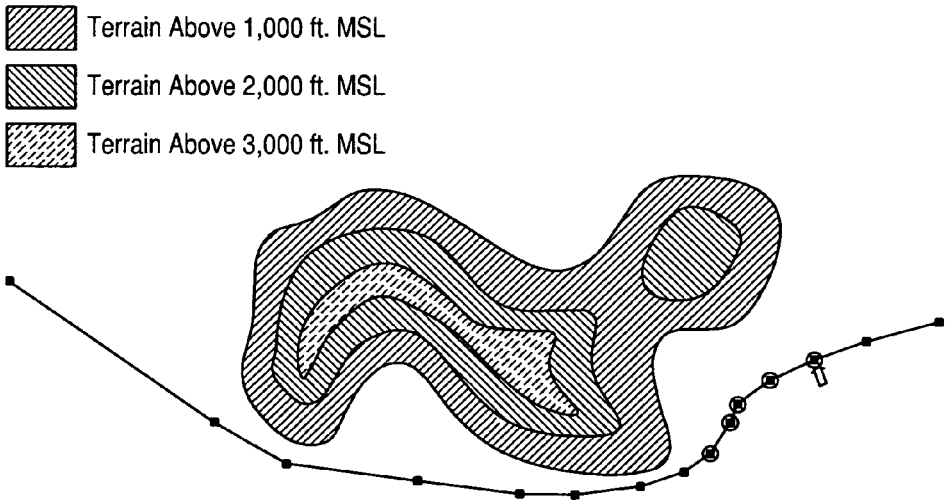
FIG. 15 illustrates selection of multiple waypoints so that they can be deleted from the flight plan.
Figure 16:
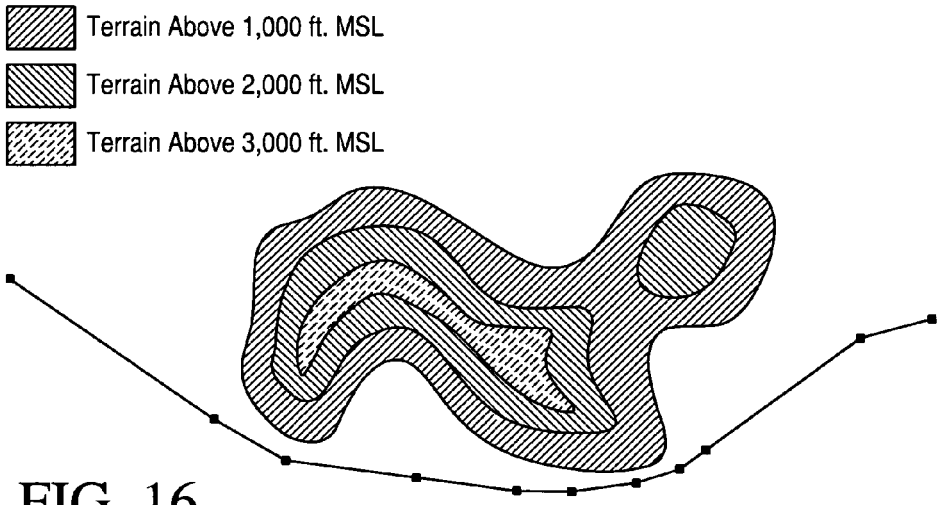
FIG. 16 illustrates the final flight plan with extraneous waypoints deleted.

In a fourth step, shown in FIG. 13, once the user completes the new flight plan, the old flight plan is deleted. The invention also allows the user to user a cursor control device to manipulate individual waypoints. This allows the user to tweak individual elements within the final flight plan. Referring to FIG. 14, it can be seen that the invention allows the user to pull an individual waypoint to provide more clearance between the flight plan and terrain. As shown in FIG. 15, the user can select multiple waypoints so that they can be deleted from the flight plan. FIG. 16 shows the final flight plan with the extraneous waypoints deleted.

Figure 17:
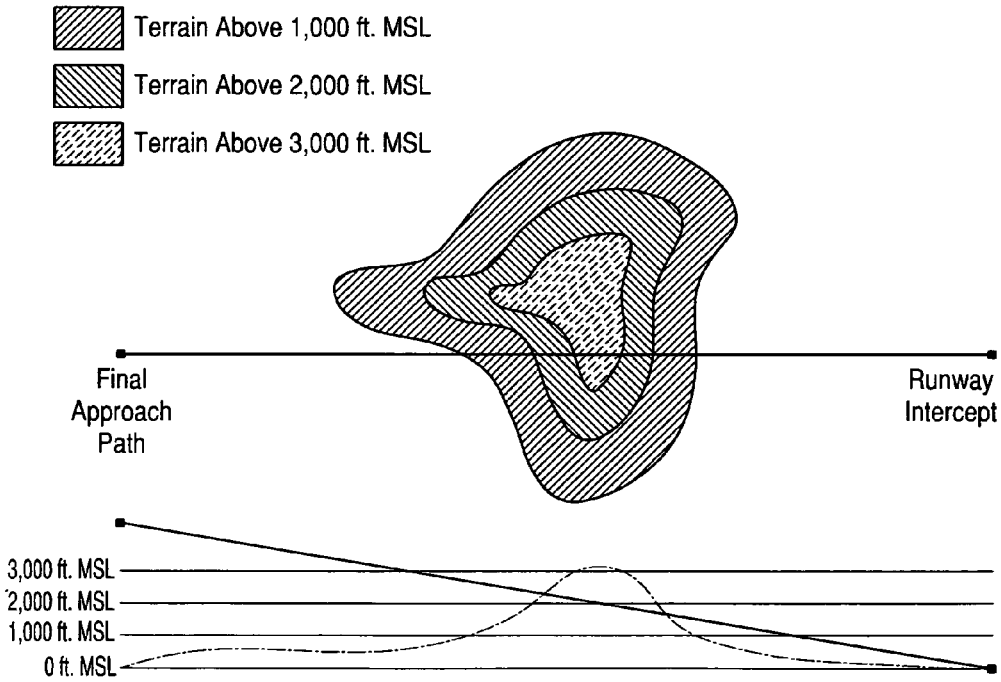
FIG. 17 illustrates a flight display including both a top-down, two-dimensional flight plan map and a side-view, of a stabilized approach, in the context of terrain, showing a terrain conflict, wherein the range and scaling of both maps is synchronized.

Referring now FIGS. 17-21, a method for creating a safe approach path in accordance with the principles of the present invention is illustrated on a flight display, including a top-down, two-dimensional flight plan map and a side-view. In FIG. 17 a stabilized approach (with a constant descent angle) from the Final Approach Fix (FAF) to the Runway Intercept is shown. The horizontal range of the horizontal situation display (top-down view) and the vertical situation display (VSD) (side view) are synchronized. From the VSD, it is apparent that the stabilized path will intersect terrain during the descent. Note that the terrain profile in the VSD represents the terrain directly below the aircraft.

Figure 18:
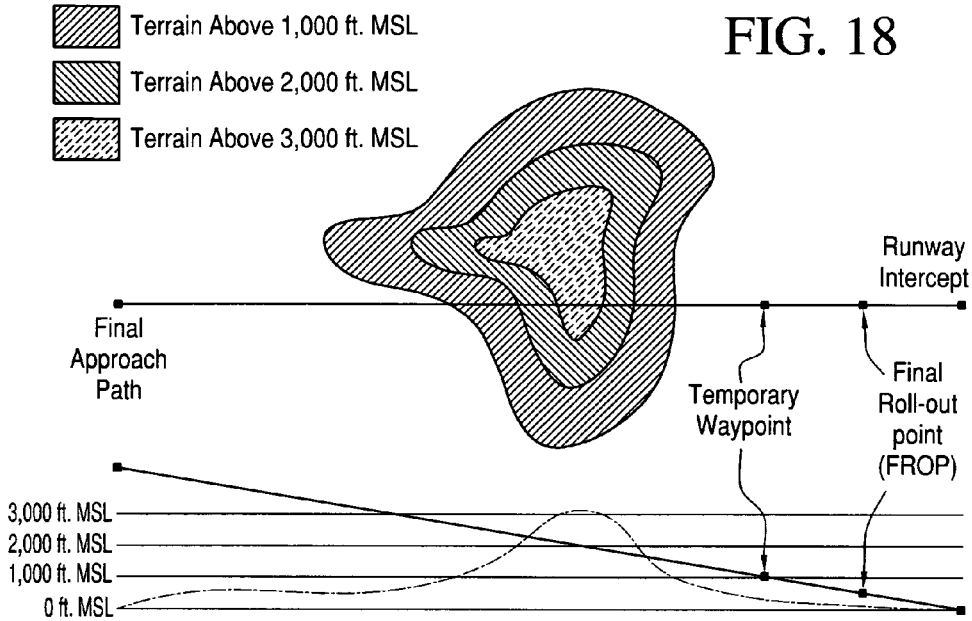
FIG. 18 shows the flight display of FIG. 17 with the insertion of a temporary waypoint and final roll-out point in the first step of defining a new approach path.

In FIG. 18 the user has inserted two new waypoints into the stabilized approach. The Final Roll-Out Point (FROP) is the point along the path where the aircraft must be 500 feet or higher above the runway elevation. The aircraft must return to wings-level by this point and then continue in a straight-in final approach. This waypoint will be calculated by the system when commanded by the user. The user also manually inserts a temporary waypoint to simplify the bending and stretching process. Note that the new path must have an inflection point because the path will bend one direction to go around the terrain, then must bend the other way so that the path will line up with the runway.

Figure 19:
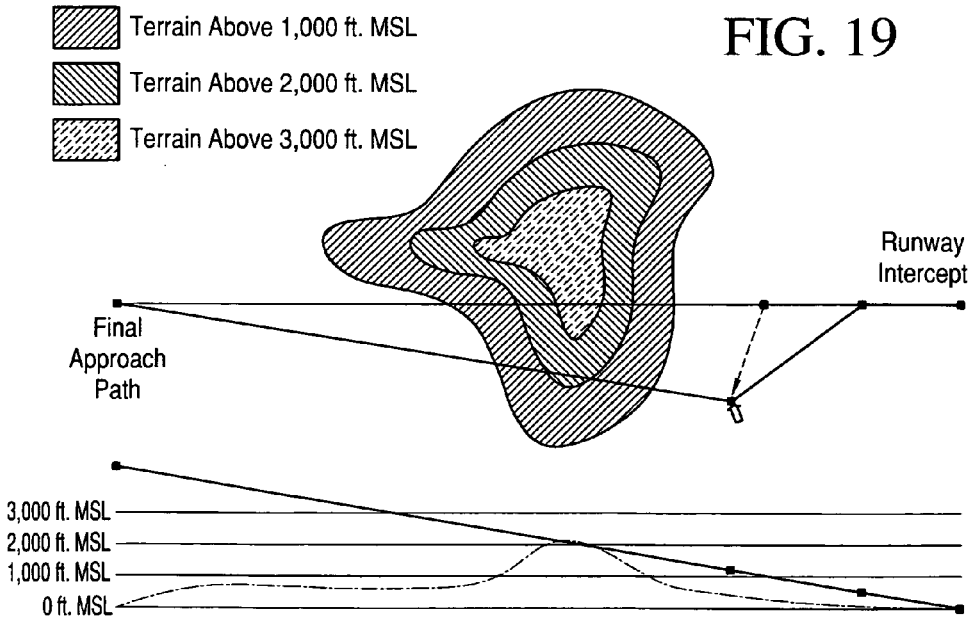
FIG. 19 shows a next step in defining the new approach path by grabbing the temporary waypoint and dragging it to a new location.

Referring now to FIG. 19, the simplest way to define the location of the inflection point (where the bent path changes direction) is to grab the temporary waypoint and drag it to a new location. Note that the terrain profile changes to reflect the new lateral path.

Figure 20:
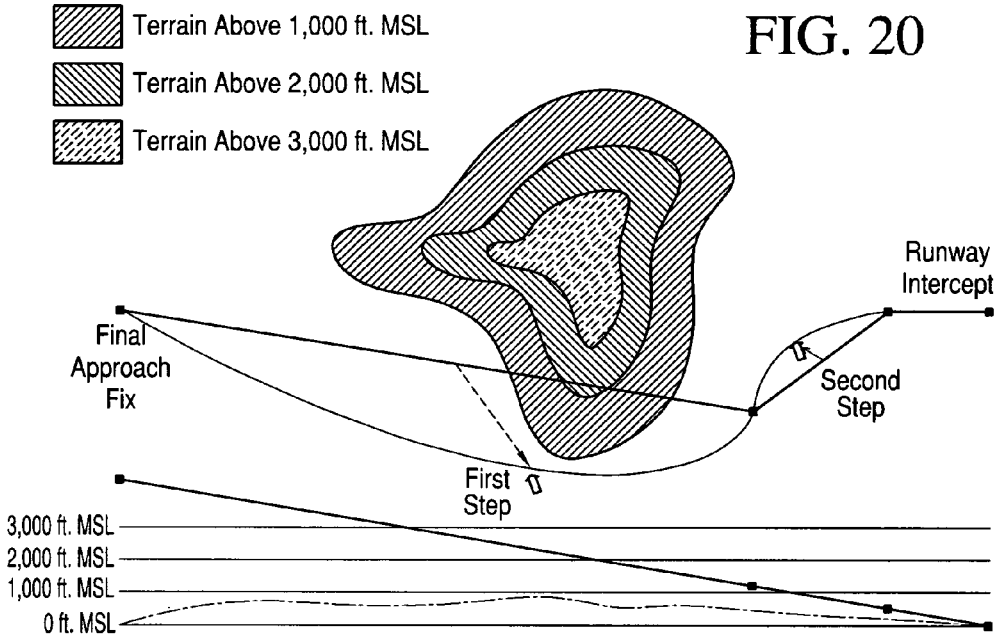
FIG. 20 illustrates various subsequent steps in bending other segments to produce a smooth transition.

As can be seen in FIG. 20, now the user can drag each flight segment in the bent path to produce a smoothly curving path. The user first grabs the segment that passes over the terrain and pulls it until all terrain conflicts are eliminated (as shown in the VSD). The user then bends the other segment to produce a smooth transition to align the flight path with the runway.

Figure 21:
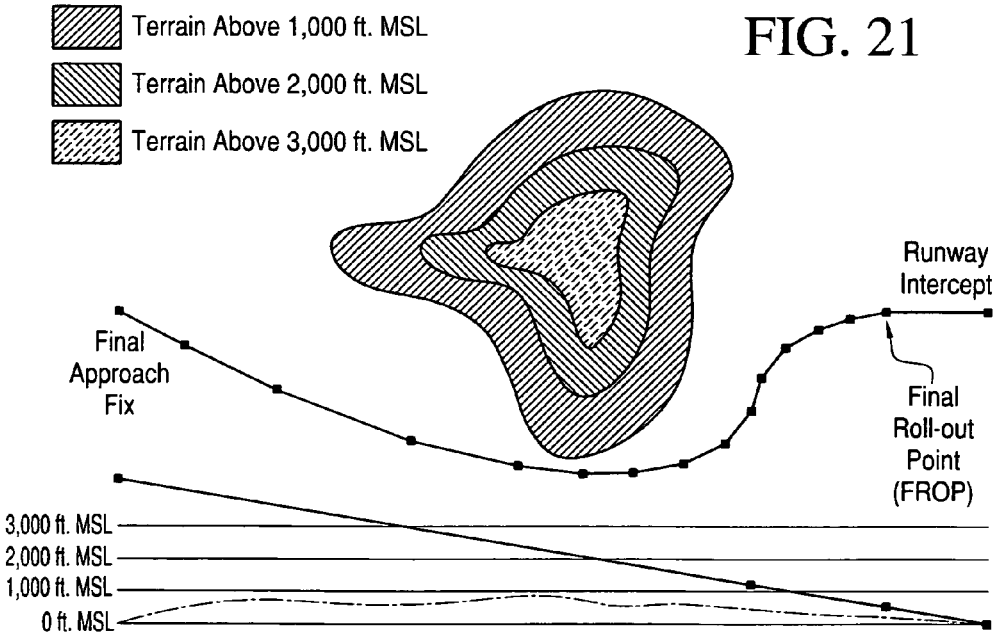
FIG. 21 shows the final step in defining a new approach path by converting the curved approach path to a series of straight flight segments.

As shown in FIG. 21, finally, the new curved approach path is converted to a series of straight flight segments defined by a collection of TF waypoints. When the aircraft follows this new flight plan, the aircraft will level-out at the FROP for a straight-in final approach.

Thus, the total user inputs required to create this complex, curved approach are limited to:

A) Command the system to insert the FROP;

B) Manually insert a temporary waypoint;

C) Drag the temporary waypoint to create an inflection point;

D) Drag a first segment to produce smoothly curving path to avoid terrain conflicts;

E) Drag a second segment to produce a smoothly curving path to the FROP; and,

F) Command the system to generate a new flight plan.

The user does not need to perform any complex logic in his/her head to compute the most desirable waypoints for a new flight plan to avoid the terrain.

Figure 22:
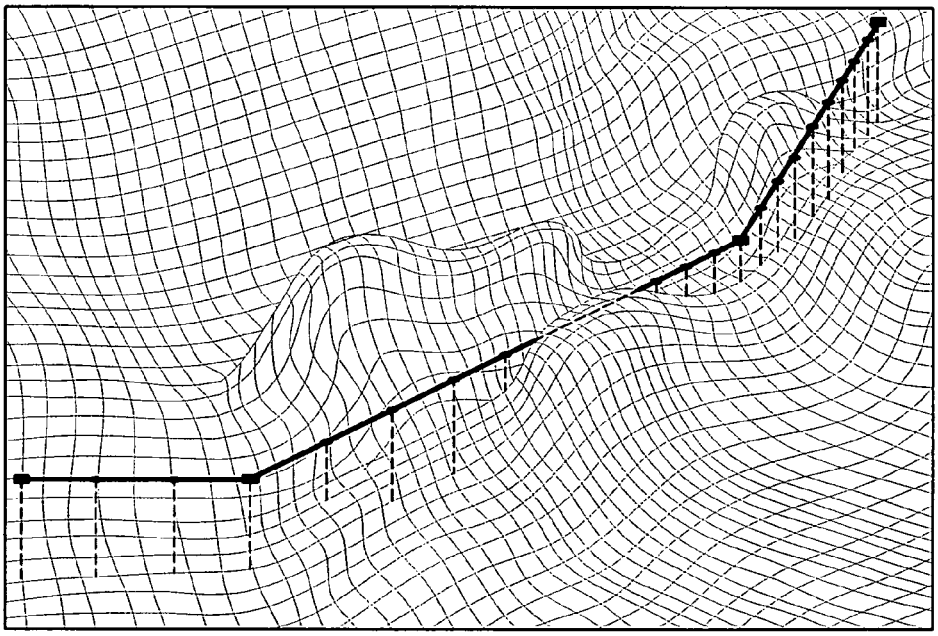
FIG. 22 illustrates a flight display including three-dimensional flight plan map showing a flight plan in the context of a three-dimensional display of terrain, in the context of terrain, showing a terrain conflict.

Referring now to FIGS. 22-29, a method for creating a safe approach path in accordance with the principles of the present invention is illustrated on a flight display, including a three-dimensional flight plan map. In FIG. 22 the three-dimensional flight plan map is shown with conflicting terrain.

Figure 23:
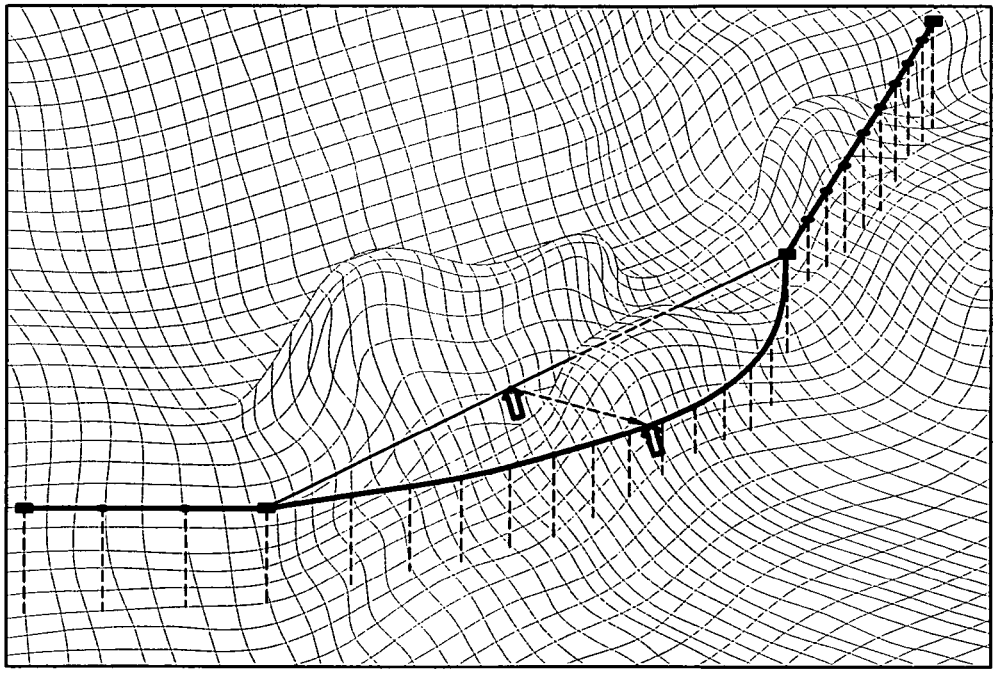
FIG. 23 shows the flight display of FIG. 22 in a first step in defining a new flight path, in which the user grabs the middle of the flight segment that is in conflict with terrain and then stretches it until there are no terrain conflicts.
Figure 24:
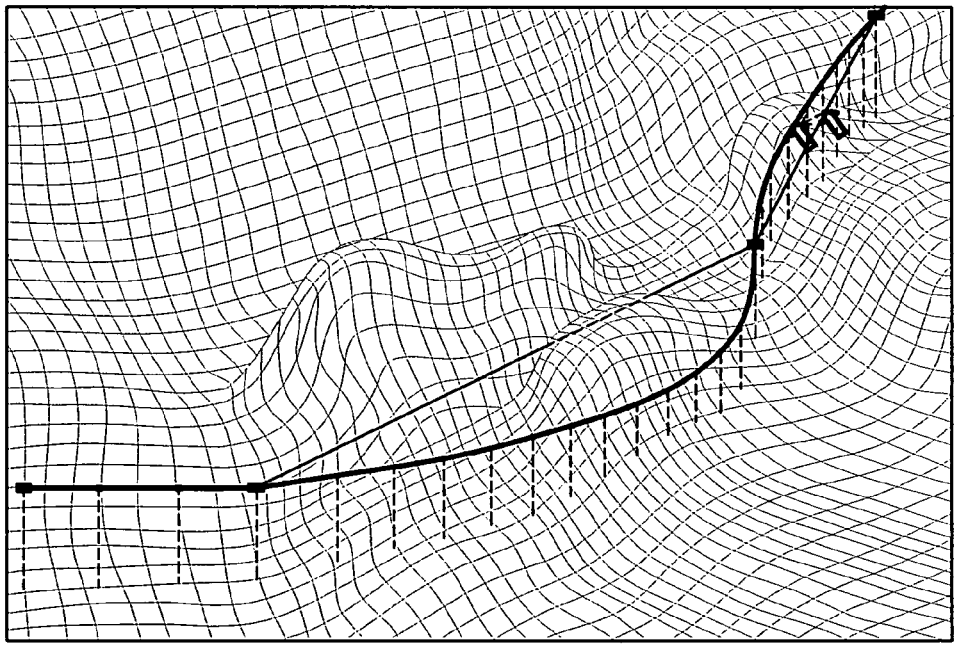
FIG. 24 shows a next step in defining the new flight path by grabbing the next flight segment and dragging it to a new location.

In FIG. 23, the user grabs the middle of the flight segment that is in conflict with terrain and then stretches it until there are no terrain conflicts. In FIG. 24 the user grabs the middle of the next segment in the flight plan and stretches it to achieve a smoother intersect between the two adjacent segments.

Figure 25:
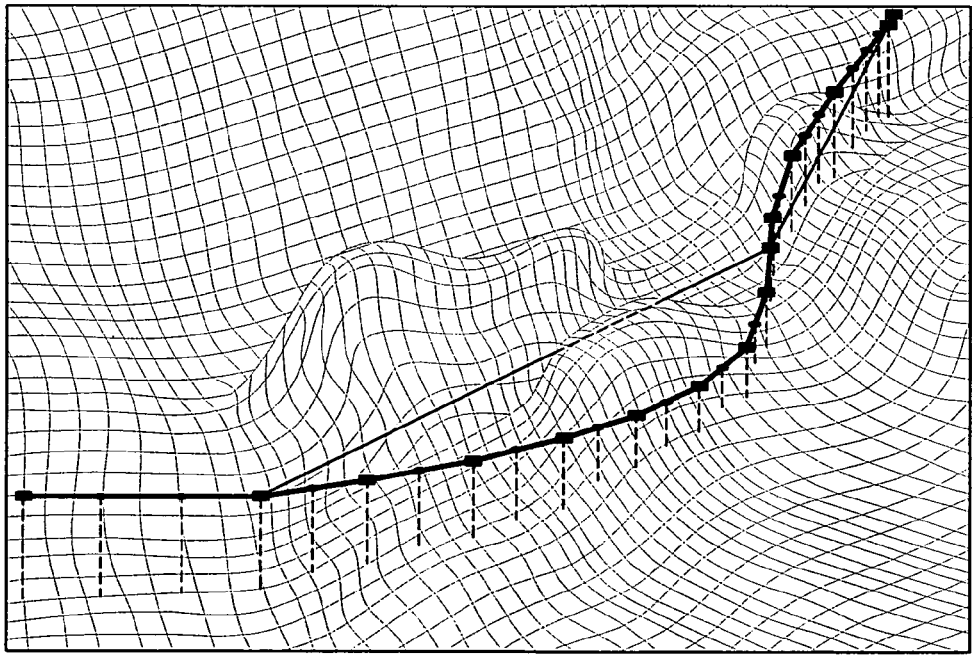
FIG. 25 shows a third step in defining the new flight path by generation of the FMS of the new flight plan using a series of short, straight segments.

In FIG. 25, the user converts the curved path into a new flight plan. The FMS generates the new flight plan using a series of short, straight segments.

Figure 26:
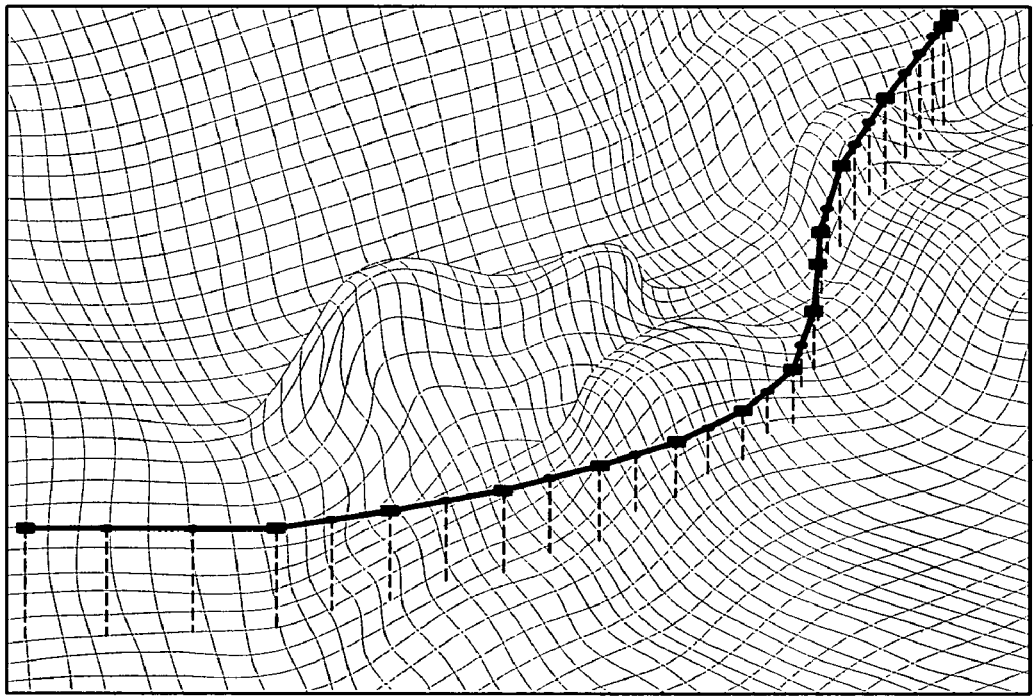
FIG. 26 shows a fourth step by deletion of the old flight plan.
Figure 27:
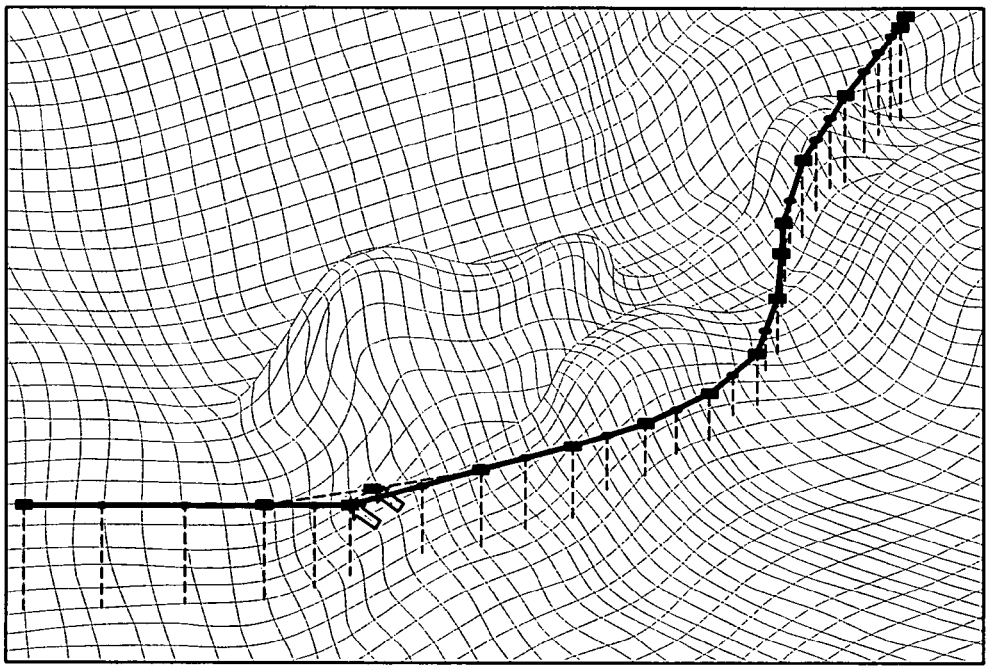
FIG. 27 illustrates a potential modification of the flight plan by pulling an individual waypoint to provide more clearance between the flight plan and terrain.
Figure 28:
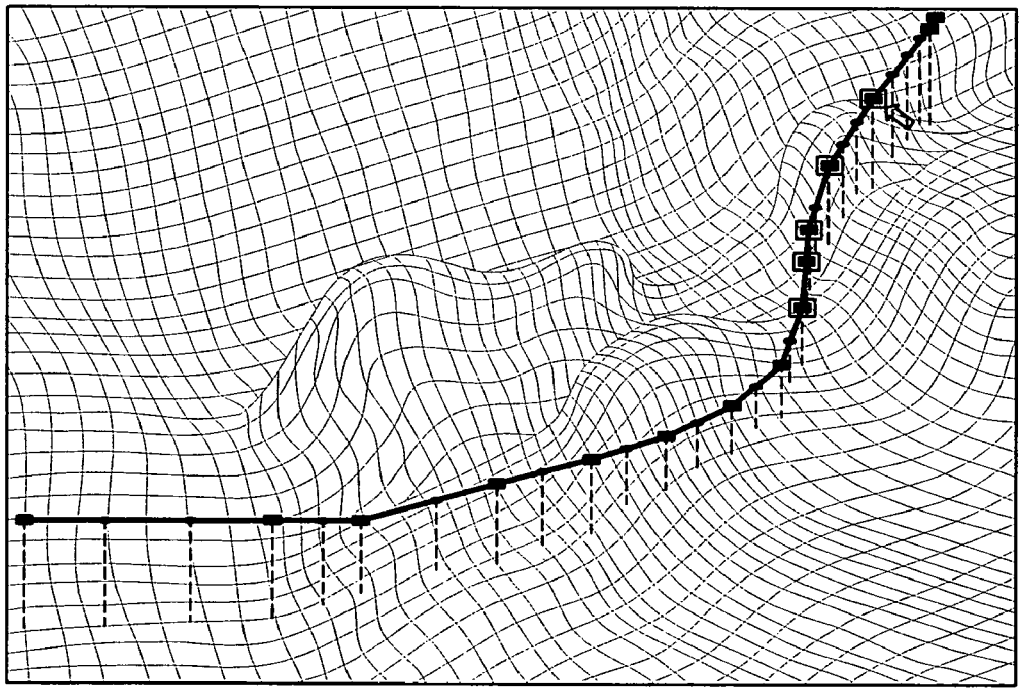
FIG. 28 illustrates selection of multiple waypoints so that they can be deleted from the flight plan.
Figure 29:
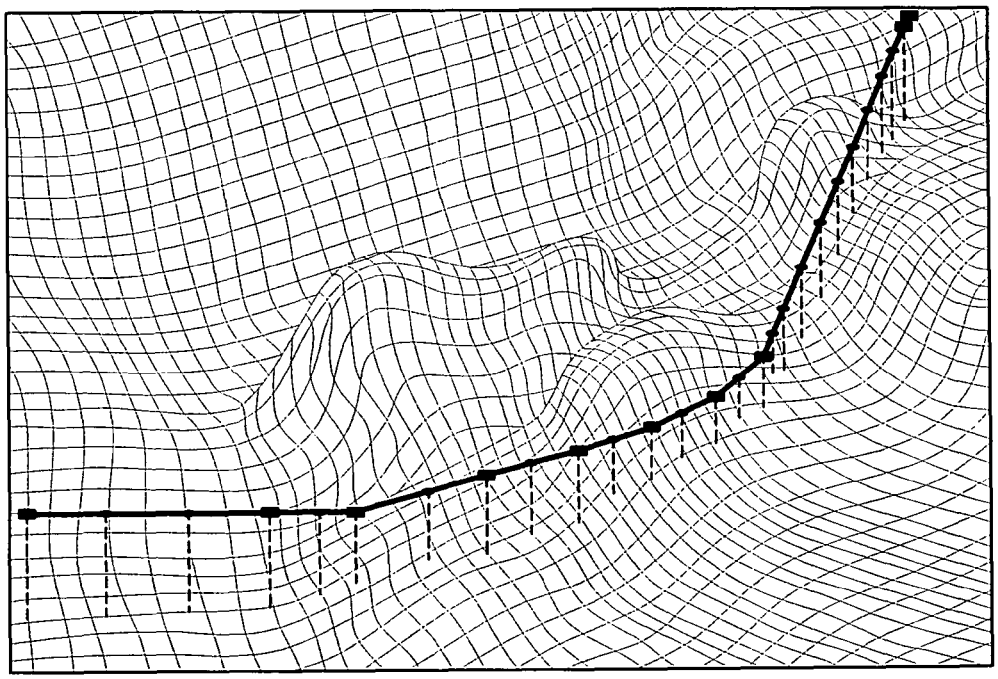
FIG. 29 illustrates the final flight plan with extraneous waypoints deleted.

As shown in FIG. 26, once the user completes the new flight plan, the old flight plan is deleted. Referring to FIG. 27, it can be seen that the invention allows the user to pull an individual waypoint to provide more clearance between the flight plan and terrain. As shown in FIG. 28, the user can select multiple waypoints so that they can be deleted from the flight plan. FIG. 29 shows the final flight plan with the extraneous waypoints deleted.

Although not shown in the figures the modified flight plan may be reviewed in the context of terrain using the cursor control device to rotate or translate the display image to view the flight plan and the terrain from multiple perspectives. The modified flight plan may be reviewed to change the range and scaling of the display using a cursor control device to zoom in or out. The modified flight plan may be selected from the reviews thereof, the modified flight having no conflicts with terrain. Finally, the modified flight plan may be activated using the FMS.

Generally, the FMS draws all pictures and sends graphics commands to the display which renders the commands into pixels. In this environment, the cursor control device talks to the FMS which interprets cursor control inputs to move waypoints or bend lines. However, alternatively, the "flight planning" can be handled in a "smart" display. In such an instance the FMS only sees the output of the flight planning (including moving waypoints and bending lines).

Other embodiments and configurations may be devised without departing from the spirit of the invention and the scope of the appended claims.

The invention claimed is:

1. A method of creating and modifying a flight plan using a cursor control device and a display to represent the flight plan in the context of terrain, comprising the steps of:

a) inserting waypoints, including origin and destination waypoints, into a flight plan using a cursor control device to position the waypoints in a display and commanding a flight management system (FMS) to connect the waypoints into a flight plan;

b) drawing said flight plan in the context of terrain on a display where conflicts between the flight plan and terrain are indicated;

c) grabbing selected elements of said flight plan with said cursor control device and dragging said selected elements to new positions on the display until terrain conflicts are eliminated, thus generating a modified flight plan;

d) reviewing the modified flight plan in the context of terrain to determine its acceptability and making further modifications thereof if desired;

e) selecting the modified flight plan from said review thereof, said modified flight plan having no conflicts with terrain; and, f) activating the modified flight plan using said FMS.

2. The method of claim 1, wherein said step of drawing a flight plan on a display comprises drawing on a top-down, two-dimensional flight plan map showing said flight plan in the context of a top-down topographic display of terrain.

3. The method of claim 1, wherein said step of drawing a flight plan on a display comprises drawing on a side-view, two-dimensional flight plan map showing said flight plan in the context of a side-view, profile display of the terrain under the flight plan.

4. The method of claim 1, wherein said step of drawing a flight plan on a display comprises drawing on both a top-down, two-dimensional flight plan map and a side-view, two-dimensional flight plan map in the context of terrain, wherein the range and scaling of both maps is synchronized.

5. The method of claim 1, wherein said step of drawing a flight plan on a display comprises drawing on a three-dimensional flight plan map showing said flight plan in the context of a three-dimensional display of terrain.

6. The method of claim 1, wherein said terrain conflicts are calculated from comparing the intended path of the aircraft, as defined by the flight plan, with the obstacle clearance requirements of Terminal Instrument Procedures (TERPS).

7. The method of claim 1, wherein said step of grabbing selected elements comprises the step of grabbing a waypoint with a cursor control device and moving the waypoint in a linear fashion in a desired direction, wherein said FMS recomputes the path of flight segments that connect the waypoint to the two adjacent waypoints in the flight plan.

8. The method of claim 1, wherein said step of grabbing selected elements comprises the step of grabbing a flight segment between two adjacent waypoints in a flight plan with the cursor control device and altering the shape of the flight segment, wherein said FMS uses aircraft performance data to limit shape of the resulting curved flight segment to prohibit flight paths which are beyond the capabilities of the aircraft.

9. The method of claim 1, wherein said steps of grabbing selected elements, reviewing said flight plan, and modifying said selected flight plan comprises the steps of:

a) grabbing the approximate middle of a flight segment that is in conflict with terrain and then stretching it until there are no terrain conflicts;

b) grabbing the middle of a next segment in the flight plan and stretching it to achieve a smoother intersect between these two adjacent segments, thus creating a curved path;

c) generating a modified flight plan by converting said curved path into a series of short, straight segments; and, d) deleting the old flight plan.

10. The method of claim 1, wherein said step of reviewing the modified flight plan comprises using a cursor control device to rotate or translate the display image to view the flight plan and the terrain from different perspectives.

11. The method of claim 1, wherein said step of reviewing the modified flight plan comprises using a cursor control device to change the range and scaling of the display using a cursor control device to zoom in or out.

12. A system for creating and modifying a flight plan using a cursor control device and a display to represent the flight plan in the context of terrain, comprising:

a) a flight management system (FMS);

b) a cursor control device operatively connectable to said FMS for inserting waypoints, including origin and destination waypoints, into a flight plan to position the waypoints in a display and commanding said FMS to connect the waypoints into a flight plan; and, c) a display operatively connected to said cursor control device and to said FMS for drawing said flight plan in the context of terrain, where conflicts between the flight plan and terrain are indicated;

wherein said cursor control device is further utilized for:

i) grabbing selected elements of said flight plan and dragging said selected elements to new positions on the display until terrain conflicts are eliminated, thus generating a modified flight plan;

ii) reviewing the modified flight plan in the context of terrain to determine its acceptability and making further modifications thereof if desired; and iii) selecting the modified flight plan from said review thereof, said modified flight plan having no conflicts with terrain;

wherein said modified flight plan is activated using said FMS.

13. The system of claim 12, wherein said flight plan is displayed on a top-down, two-dimensional flight plan map showing said flight plan in the context of a top-down topographic display of terrain.

14. The system of claim 12, wherein said flight plan is displayed on a side-view, two-dimensional flight plan map showing said flight plan in the context of a side-view, profile display of the terrain under the flight plan.

15. The system of claim 12, wherein said flight plan is displayed on a top-down, two-dimensional flight plan map and a side-view, two-dimensional flight plan map in the context of terrain, wherein the range and scaling of both maps is synchronized.

16. The system of claim 12, wherein said flight plan is displayed on a three-dimensional flight plan map showing said flight plan in the context of a three-dimensional display of terrain.

* * * * *